US007946559B2

(12) United States Patent
Vandelinde

(10) Patent No.: US 7,946,559 B2
(45) Date of Patent: May 24, 2011

(54) CABLE DRIVE ASSEMBLY

(76) Inventor: Henry Vandelinde, Queensville (CA)

( * ) Notice: Subject to any disclaimer, the term of this patent is extended or adjusted under 35 U.S.C. 154(b) by 0 days.

(21) Appl. No.: 12/585,175

(22) Filed: Sep. 8, 2009

(65) Prior Publication Data

US 2011/0057159 A1 Mar. 10, 2011

(51) Int. Cl.
*B66D 5/08* (2006.01)

(52) U.S. Cl. ..... 254/378; 254/375; 254/380

(58) Field of Classification Search ..... 254/278, 254/322, 371, 375, 378, 379, 380
See application file for complete search history.

(56) References Cited

U.S. PATENT DOCUMENTS 2,080,804 A * 5/1937 Brantly ..... 173/1
3,322,398 A * 5/1967 Smith ..... 254/346
4,145,028 A * 3/1979 Kelley et al. ..... 254/346
4,162,059 A * 7/1979 Fletchall ..... 254/358
4,552,340 A * 11/1985 Sheppard ..... 254/358
5,921,529 A * 7/1999 Wilson et al. ..... 254/346

* cited by examiner

*Primary Examiner* — Emmanuel M Marcelo
(74) *Attorney, Agent, or Firm* — Arne I. Fors

(57) ABSTRACT

A dismantable hoist for storing and transporting wire rope and for lowering and raising the wire rope from a building roof site including a lightweight frame having a base, lightweight reel, for storing the wire rope, having a central drum and a pair of spaced-apart peripheral rings attached to the drum forming opposed side flanges rotatably mounted in the frame, drive means removably attached to the drum for rotating the drum for lowering and raising the wire rope, and brake means operatively connected to the spaced-apart peripheral rings and normally biased into braking engagement with the peripheral rings to stop lowering of the wire rope upon release of the brake means. The brake means include a pair of opposed brake shoes pivotably mounted in the frame to engage each of the peripheral rings, biasing means for normally urging each pair of opposed brake shoes towards each other for engaging and braking the peripheral ring therebetween, and a lever pivotably mounted in the frame to operatively engage the brake shoes for disengaging the brake shoes from the peripheral rings upon manually actuating the lever, whereby the drum is released for lowering or raising the wire rope.

5 Claims, 5 Drawing Sheets

CABLE DRIVE ASSEMBLY

BACKGROUND OF THE INVENTION (i) Field of the Invention

This invention relates to the cable drive assembly and more particularly, to a modular cable drive hoist assembly for transporting and for raising and lowering wire cables.

(ii) Description of the Related Art

Workers rigging suspended scaffolds on high rise buildings are required to lower steel wire ropes or cables over the side of the building. These ropes are attached to outrigger beams or other similar support systems on a roof top and the ropes are then fed through electric hoists on the scaffold platform so that the platform can be used to access the building wall face.

On buildings of moderate height, the weight of the wire ropes can be managed relatively easily by workers. However, as building heights increase the weight of the wire ropes becomes very difficult to handle. In addition, the fact that the wire ropes need to be lowered over the side of the building and connected to the support system outboard of the wall face presents a very real safety hazard.

With consideration to these concerns, various safety standards have indicated that mechanical means such as an electric hoist should be used for raising and lowering the wire ropes during the rigging process on taller structures. However to date no one has developed a suitable product to address this need.

It is a principal object of the present invention to provide a modular dismantable hoist system so that individual hoist components can be easily transported to a building location and up to the building roof for reassembly on site.

It is another object of the invention to provide a portable hoist system for the safe handling and raising and lowering of wire ropes from tall buildings.

SUMMARY OF THE INVENTION

In its broad aspect, the dismantable hoist of the present invention for storing and transporting wire rope and for lowering and raising said wire rope from a building roof site comprises a lightweight frame having a base, lightweight reel for storing the wire rope, said reel having a central drum and a pair of spaced-apart peripheral rings attached to the drum forming opposed side flanges, said lightweight reel rotatably and removably mounted in the frame, drive means removably attached to the drum for rotating the drum for lowering and raising the wire rope, and brake means operatively connected to the spaced-apart peripheral rings and normally biased into braking engagement with the peripheral rings to stop lowering of the wire rope upon release of the brake means.

More particularly, the brake means comprise a pair of opposed brake shoes pivotably mounted in the frame to engage each of said peripheral rings, biasing means for normally urging said each said pair of opposed brake shoes towards each other for engaging and braking the peripheral ring there between, a lever pivotably mounted in the frame to operatively engage the brake shoes for disengaging the brake shoes from the peripheral rings upon manually actuating the lever, whereby the drum is released for lowering or raising the wire rope. Each pair of opposed brake shoes pivotably mounted in the frame comprises a pair of opposed U-shaped members each having upper and lower arms with distal and proximal ends joined at the proximal end by a web, means for pivoting the upper arm at the web in the frame adjacent the proximal end, a brake shoe attached to the distal end of the lower arm for engagement with the peripheral ring, a pair of tension springs attached to opposing lower arms for urging the brake shoes attached to the lower arms together, and detent means formed on the distal ends of the upper arms for abutment by the lever for downward pivotal movement of the upper arms and disengagement of the brake shoes from the peripheral rings. The reel central drum has a shaft concentric with the drum, and wire rope engaging means formed on the drum adapted to be in radial alignment with the shaft upon full extension of the wire rope. The drive means comprise a portable electric drive motor and gear box unit, and connector means for removably connecting the electric drive motor and gear box unit to the shaft. The lightweight reel is rotatably mounted in the frame by bearing blocks attached to the frame, said bearing blocks having means for removably attaching the shaft thereto.

The lightweight aluminum drum is designed to be carried or rolled with the suspension rope already installed. The tubular external rings form the drum flanges while providing user friendly handling. The support frame and outer sheave units are fabricated from aluminum for light weight and are designed to pin to a modular beam system which forms the base of the suspension system.

A single portable drive motor and gearbox unit can be used to operate multiple cable drives. When the cable drive motor is engaged it provides the driving force to raise or lower the wire ropes. A manually operated brake system that is designed to grip the tubular drum flanges must be held in the released position while the motor is operating. This brake system is spring applied so that in the event of a drive system malfunction the user only needs to release the brake lever to allow it to engage and stop the descent of the wire rope. The brake system can also be used to lower the wire rope without the use of the drive motor. In this instance the operator uses the brake lever to control the descent speed.

Once the wire rope is fully extended the connection to the drum comes into radial alignment, with the drum shaft so that there is no longer any torque delivered to the drive or the brake system. The wire rope is left in this neutral position and, as it leads out over a sheave to the desired suspension location outboard of the building, there is no need for the worker to handle the wire rope at the roof edge.

BRIEF DESCRIPTION OF THE DRAWINGS

The cable drive and hoist of the present invention will now be described with reference to the accompanying drawings, in which.

DESCRIPTION OF THE PREFERRED EMBODIMENT

Figure 1:
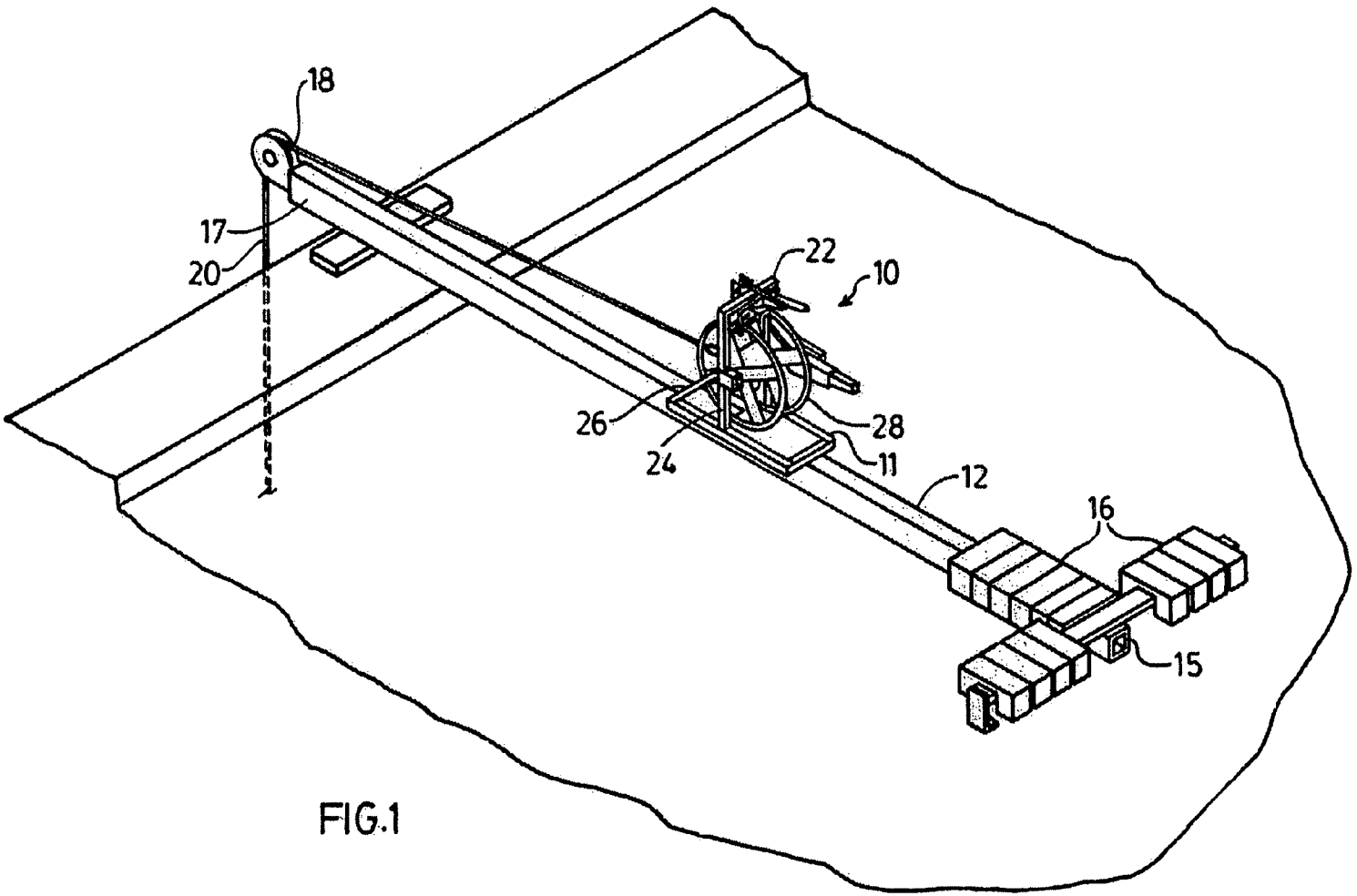
FIG. 1 is a perspective view cable drive hoist assembly of the invention typified in a roof site installation.
Figure 2:
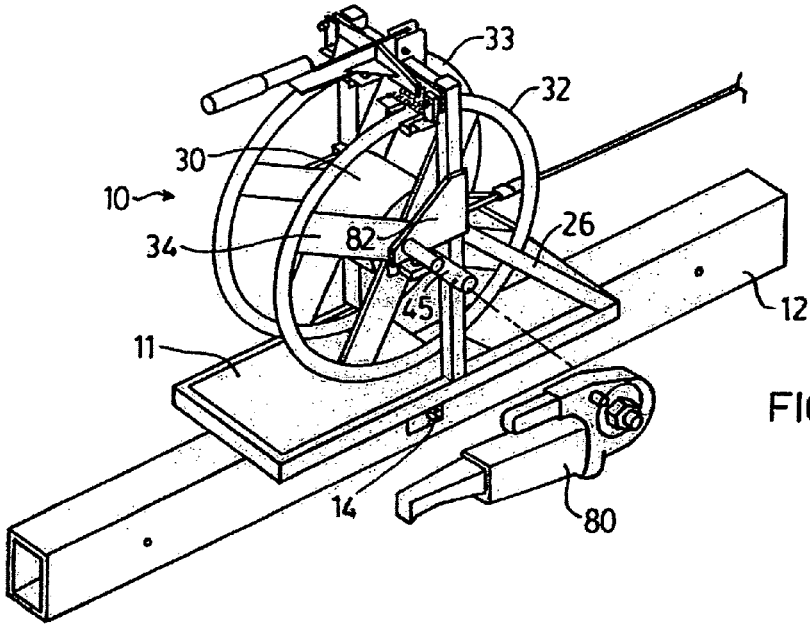
FIG. 2 is a perspective view of the hoist assembly mounted on an outrigger beam with the drive motor axially separated from the hoist drive shaft.

With reference to FIGS. 1 and 2, the hoist 10 of the invention consists of a base 11 slidably mounted on a outrigger beam 12 normally formed from an aluminum extrusion and locked thereon by pin or bolt 14. The proximal end 15 of rail 12 is held down by weights 16 and the distal end 17 which overhangs the building roof supports sheave 18 rotatably mounted to support and guide wire cable 20.

Figure 3:
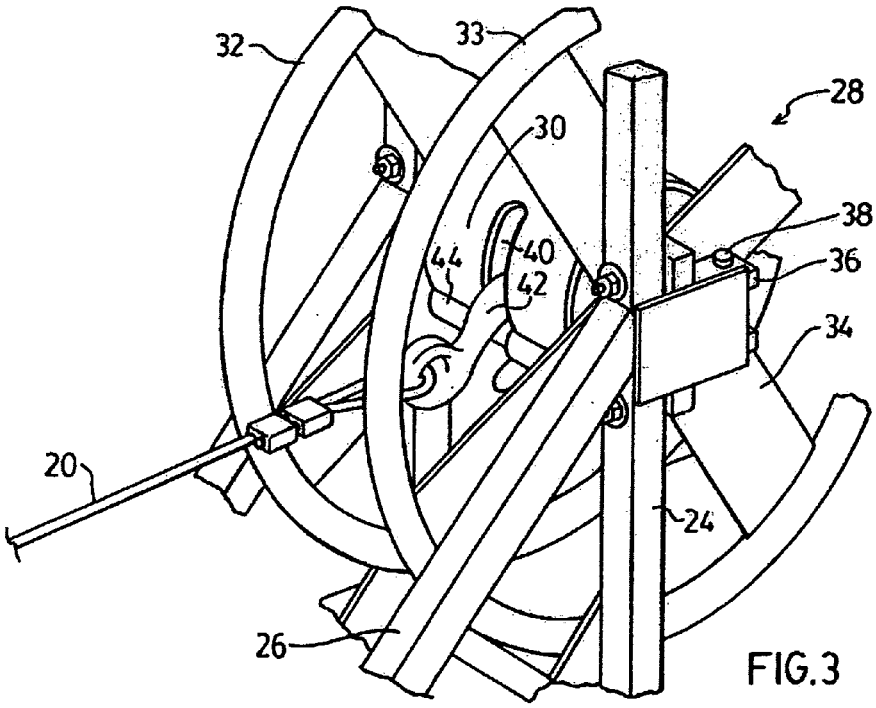
FIG. 3 is a perspective view of the opposite side of the hoist drum shown in FIG. 2 with the wire rope connected to the hoist drum.
Figure 4:
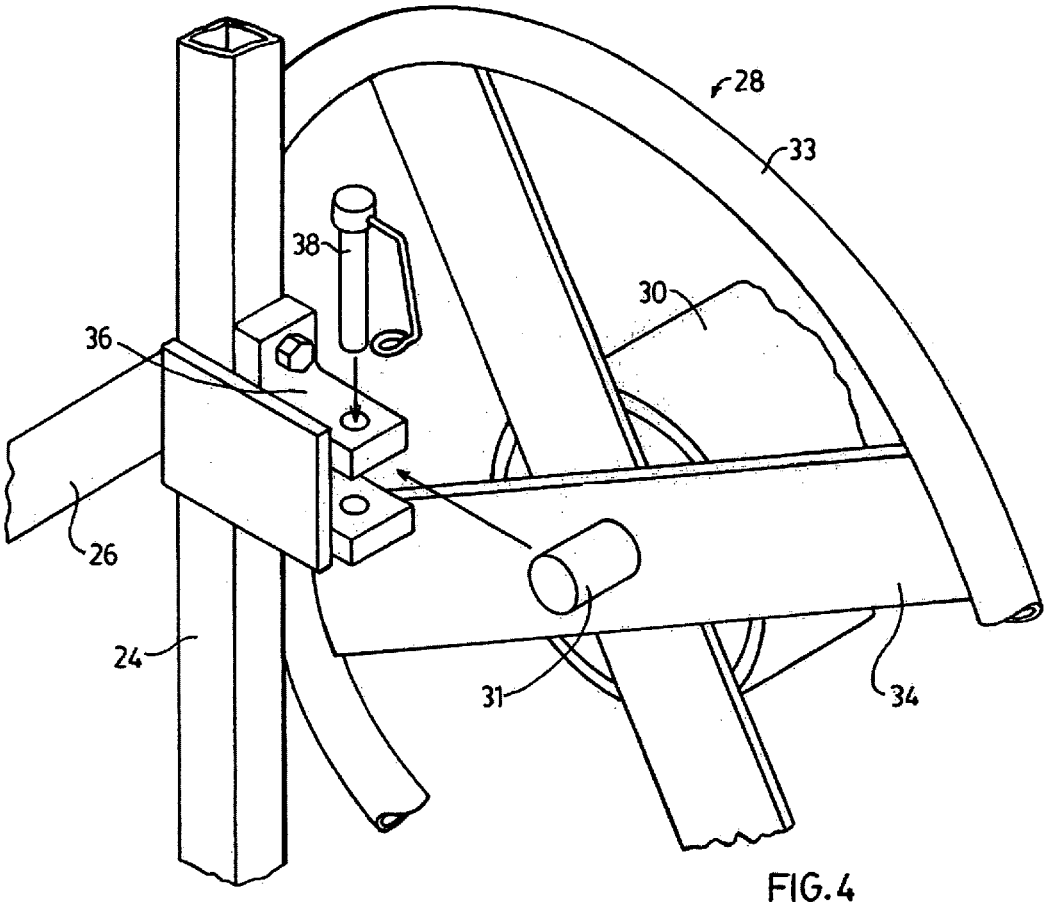
FIG. 4 is an enlarged exploded perspective view of the bearing block connection of the drum shaft to the frame.
Figure 5:
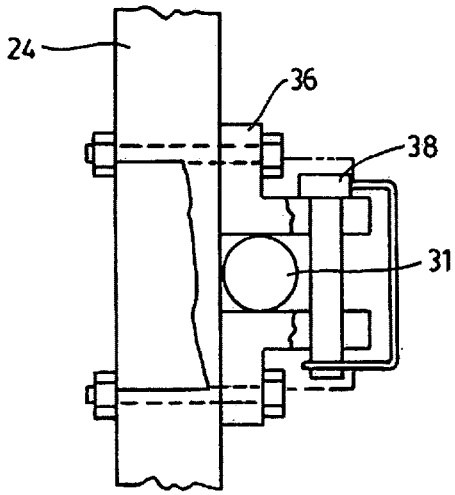
FIG. 5 is an enlarged sectional view, partly cut away, of the bearing block shown in FIG. 4.

Base 11 supports a frame 22 having spaced-apart upright side members 24 each rigidly supported by diagonal members 26 welded or bolted to base 11 and to upright members 24. Reel 28 consisting of drum 30 with central shaft 31 having spaced-apart peripheral rings 32, 33 connected thereto by radial spokes 34 is journaled for rotation at each side in upright members 24 by bearing blocks 36, shown in FIGS. 3 and 4, supporting shaft 31. Each of bearing blocks 36 has a clevis pin 38 for release of reel 28 with shaft 31 therefrom, as shown in FIG. 4. Drum 30 has an opening 40 for attachment of wire hook 42 to pin 44 which is in radial alignment with shaft 45, as depicted in FIG. 3, when the wire rope 20 is fully extended.

Figure 6:
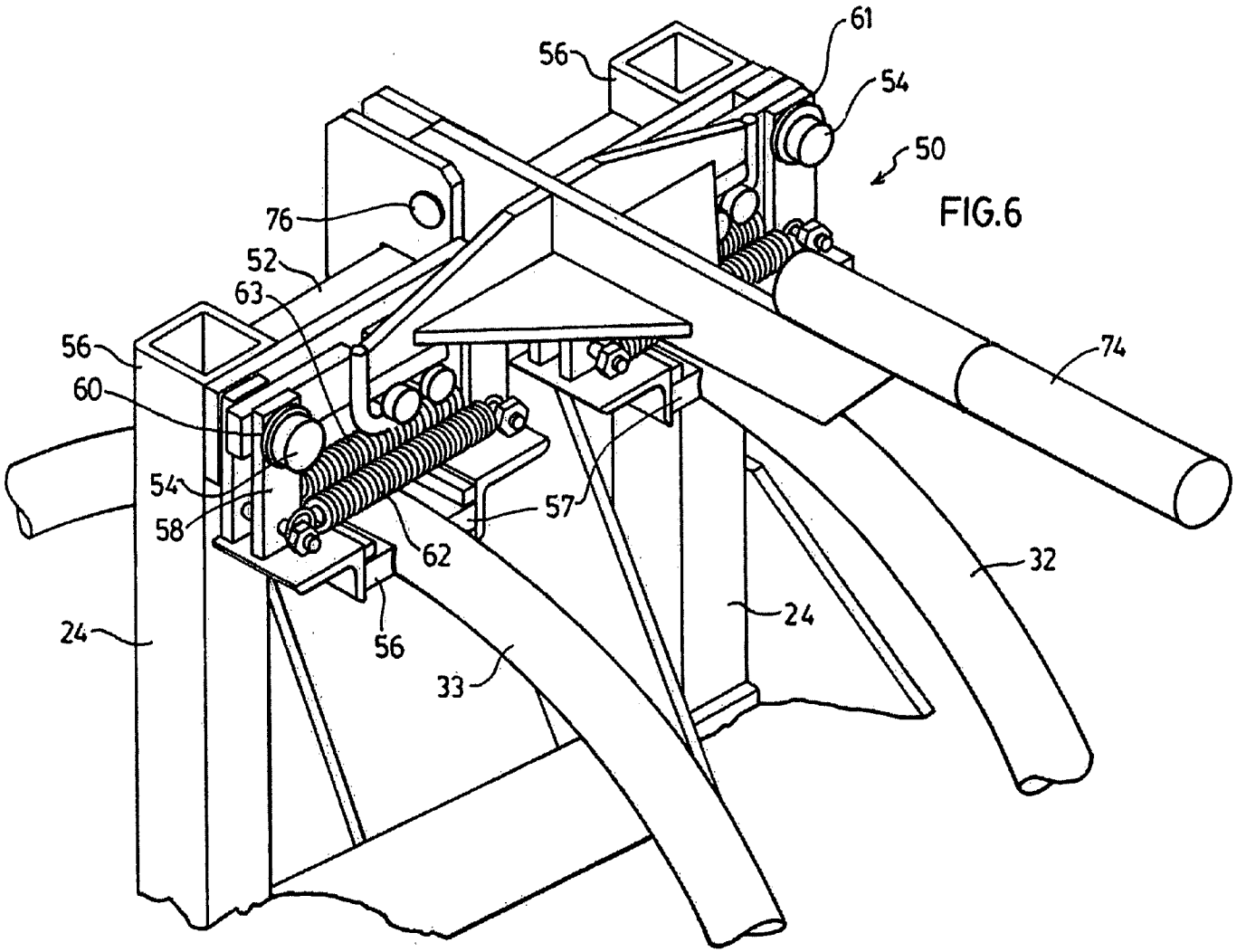
FIG. 6 is an enlarged perspective view of the brake mechanism of the invention in a normal at-rest braking position.
Figure 7:
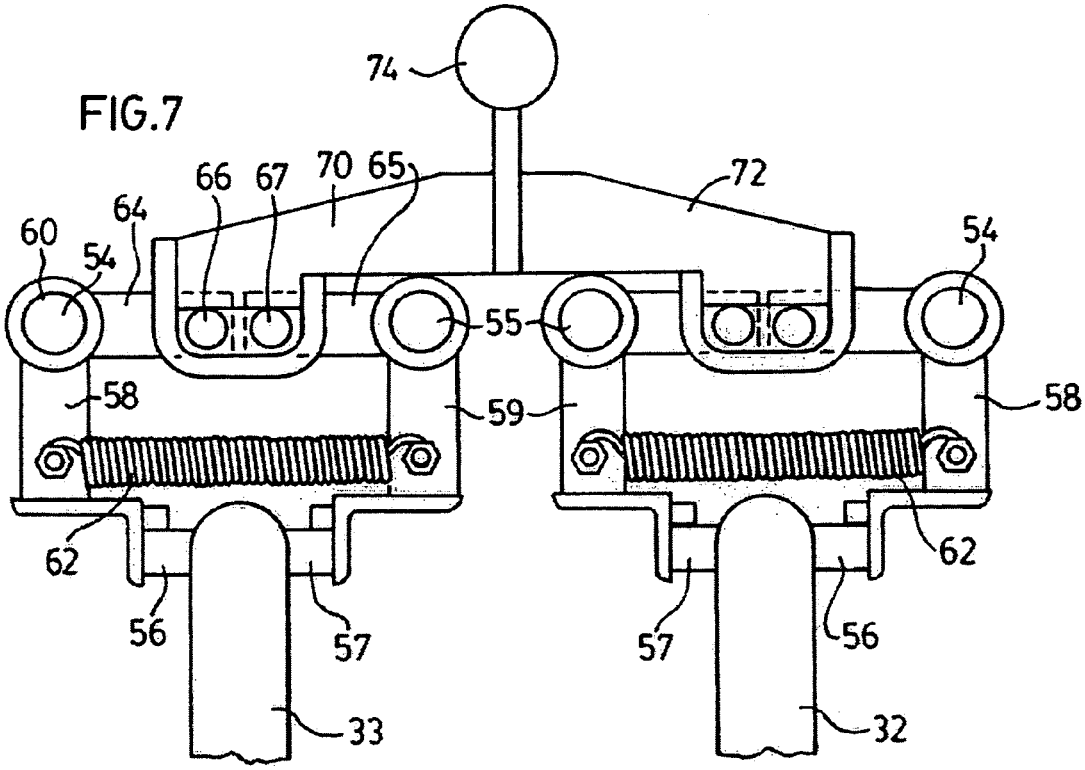
FIG. 7 is an enlarged sectional view of the brake mechanism shown in FIG. 6 in the normal at-rest braking position.
Figure 8:
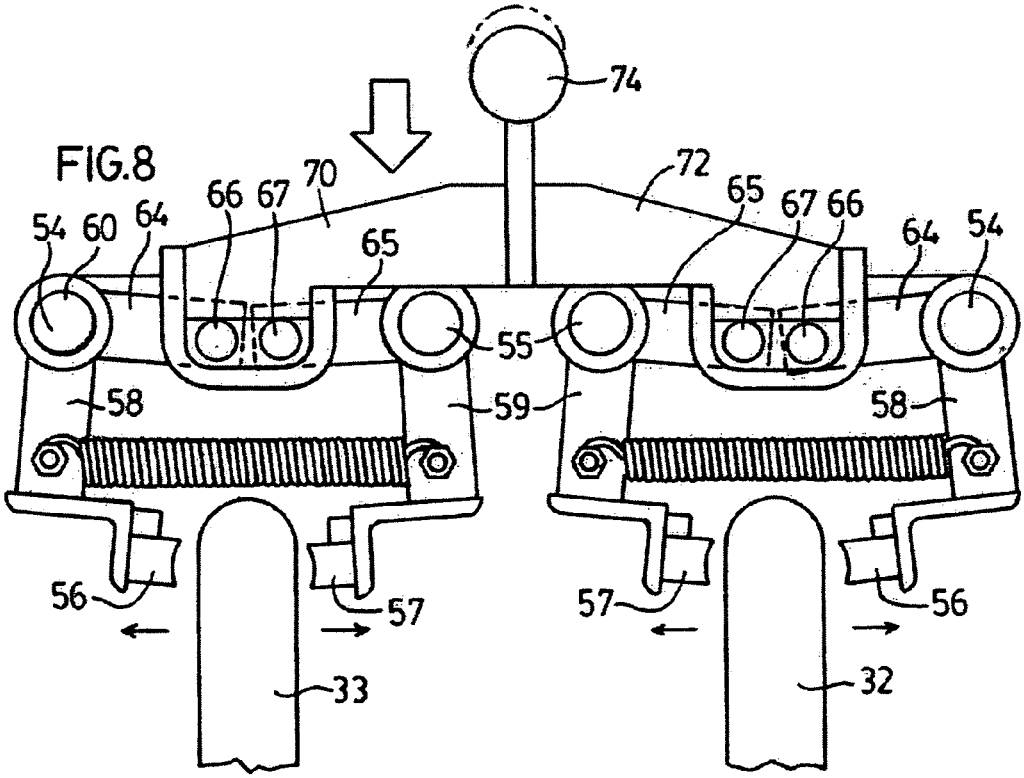
FIG. 8 is an enlarged sectional view of the brake mechanism in an actuated released position.

Turning now to FIGS. 6-8, deadman brake 50 is mounted at the top of hoist 10 by securement such as by bolt connectors 54, 55 to the upper ends 56 of upright members 24. Opposed brake shoes 56, 57 which abut the opposite sides of peripheral rings 32, 33 are mounted in U-shaped levers 58, 59 which are pivotally mounted at their upper corners 60, 61 by the connectors 54, 55. A pair of tension springs 62, 63 attached to levers 58, 59 normally urges brake shoes 56, 57 towards each other about pivot connectors 54, 55 for braking engagement with peripheral rings 32, 33, as shown in FIGS. 6 and 7. The upper arms 64, 65 of each U-shaped levers 58, 59 preferably has protrusions 66, 67 for abutment by wings 70, 72 of lever 74 which is pivotably mounted by pin 76 for vertical pivotal travel, as depicted in FIG. 8, for release of rings 32, 33 by downward actuation of lever 74.

With reference to FIG. 2, electric motor and gear box unit 80 is removably mounted on bracket 82 for engagement with shaft 45 of drum 30 for selectively unwinding wire, rope 20 from or onto drum 30.

The present invention provides a number of important advantages. The hoist dismantled components are transported individually to a roof site and assembled with the distal end 17 of outrigger beam having sheave 18 overhanging the side of a building. Weights 16 are mounted on the proximal end 15 of rail 12. Hoist base 11 slidably mounted on rail 12 is locked in position by wing screw or bolt 14. Reel 28 having wire cable 20 is mounted in frame 22 by engagement of clevis pins 38 with bearing blocks 36. Wire cable 20 is fed over the side of the building by sheave 18 and lowered by release of deadman brake 50 with or without the aid of electric motor 80.

The portable electric drive motor and gearbox unit 80 can be used to lower and raise wire cable 20. When the cable drive motor is engaged, it provides the driving force to raise or lower the wire ropes. The manually operated brake system 50 that is designed to grip the tubular rings 32, 33 must be held in the downward released position while the motor is operating. This brake system is spring applied so that in the event of a drive system malfunction the user only needs to release the brake lever to allow the brakes to engage and stop the descent of the wire rope. The brake system can also be used to lower the wire rope without the use of the drive motor. In this instance the operator uses the brake lever to control the descent speed.

Once the wire rope is fully extended, typically up to 700 feet in length, the connection to the drum comes into radial alignment with the drum shaft 45 so that there is no longer any torque delivered to the drive or the brake system. The wire rope once it has been fully led out over sheave 18 to the desired suspension location outboard of the building can be left untended in this position and there is no need for the worker to handle or monitor the wire rope at the roof edge.

It will be understood that other embodiments and examples of the invention will be readily apparent to a person skilled in the art, the scope and purview of the invention being defined in the appended claims.

The invention claimed is:

1. A dismantable hoist for storing and transporting wire rope and for lowering and raising said wire rope from a building roof site comprising:

a lightweight frame having a base, lightweight reel for storing the wire rope, said reel having a central drum and a pair of spaced-apart peripheral rings attached to the drum forming opposed side flanges, said lightweight reel rotatably mounted in the frame, drive means removably attached to the drum for rotating the drum for lowering and raising the wire rope, and brake means operatively connected to the spaced-apart peripheral rings and normally biased into braking engagement with the peripheral rings to stop lowering of the wire rope upon release of the brake means comprising a pair of opposed brake shoes pivotably mounted in the frame to engage each of said peripheral rings, biasing means for normally urging said each said pair of opposed brake shoes towards each other for engaging and braking the peripheral ring therebetween and a lever pivotably mounted in the frame to operatively engage the brake shoes for disengaging the brake shoes from the peripheral rings upon manually actuating the lever, whereby the drum is released for lowering or raising the wire rope.

2. A dismantable hoist as claimed in claim 1, in which each pair of opposed brake shoes pivotably mounted in the frame comprises a pair of opposed U-shaped members each having upper and lower arms with distal and proximal ends joined at the proximal end by a web, means for pivoting the upper arm at the web in the frame adjacent the proximal end, a brake shoe attached to the distal end of the lower arm for engagement with the peripheral ring, a pair of tension springs attached to opposing lower arms for urging the brake shoes attached to the lower arms together, and detent means formed on the distal ends of the upper arms for abutment by the lever for downward pivotal movement of the upper arms and disengagement of the brake shoes from the peripheral rings.

3. A dismantable hoist as claimed in claim 2, in which said drive means comprise a portable electric drive motor and gear box unit, and connector means for removably connecting the electric drive motor and gear box unit to the shaft.

4. A dismantable hoist as claimed in claim 1, in which the reel central drum has a shaft concentric with the drum, and wire rope engaging means formed on the drum adapted to be in radial alignment with the shaft upon full extension of the wire rope.

5. A dismantable hoist as claimed in claim 4, in which the lightweight reel is rotatably mounted in the frame by bearing blocks attached to the frame, said bearing blocks having means for removably attaching the shaft thereto.

* * * * *